US008523139B2

(12) United States Patent
Sakamoto et al.

(10) Patent No.: US 8,523,139 B2
(45) Date of Patent: Sep. 3, 2013

(54) SELECTOR VALVE OPERATING MECHANISM FOR WORKING VEHICLE

(75) Inventors: Kunihiko Sakamoto, Fukuoka (JP); Nagahiro Ogata, Fukuoka (JP); Masaaki Yamashita, Fukuoka (JP)

(73) Assignee: Yanmar Co., Ltd., Osaka (JP)

( * ) Notice: Subject to any disclaimer, the term of this patent is extended or adjusted under 35 U.S.C. 154(b) by 285 days.

(21) Appl. No.: 13/119,034

(22) PCT Filed: Aug. 5, 2009

(86) PCT No.: PCT/JP2009/063866

§ 371 (c)(1),
(2), (4) Date: Mar. 15, 2011

(87) PCT Pub. No.: WO2010/032565

PCT Pub. Date: Mar. 25, 2010

(65) Prior Publication Data

US 2011/0175005 A1 Jul. 21, 2011

(30) Foreign Application Priority Data

Sep. 19, 2008 (JP) ..... 2008-241144

(51) Int. Cl.
*F16K 31/12* (2006.01)
*F15B 13/044* (2006.01)
*F01B 1/00* (2006.01)

(52) U.S. Cl.
USPC ..... 251/30.01; 251/58; 251/59; 91/459; 91/183

(58) Field of Classification Search
USPC ..... 251/30.01, 58, 59, 62; 137/625.65; 91/534, 183, 459
See application file for complete search history.

(56) References Cited

U.S. PATENT DOCUMENTS

| | | | | |
|---|---|---|---|---|
| 2,947,285 | A * | 8/1960 | Baltus et al. | 91/387 |
| 3,739,813 | A * | 6/1973 | Worden | 137/625.65 |
| 4,044,652 | A * | 8/1977 | Lewis et al. | 91/368 |
| 5,044,608 | A * | 9/1991 | Hidaka et al. | 254/266 |
| 5,102,102 | A * | 4/1992 | Hidaka et al. | 254/266 |

FOREIGN PATENT DOCUMENTS

| | | |
|---|---|---|
| JP | 2003-176549 | 6/2003 |
| JP | 2004-257405 | 9/2004 |
| JP | 2007-092763 | 4/2007 |

OTHER PUBLICATIONS

English Translation of International Search Report for International Application No. PCT/JP2009/063866, Japanese Patent Office mailed Nov. 10, 2009, 1 page.

* cited by examiner

*Primary Examiner* — John K Fristoe, Jr.
*Assistant Examiner* — Michael R Reid
(74) *Attorney, Agent, or Firm* — Sterne Kessler Goldstein & Fox P.L.L.C.

(57) ABSTRACT

A selector valve operating mechanism is provided with operating pistons which are hydraulic pistons connected through an operation link to a spool of a PTO selector valve, an solenoid valve for hydraulically controlling reciprocation of the operating pistons, and a controller which is a control device for transmitting an operation signal to the solenoid valve. Control of operation of the solenoid valve moves the spool through the operating pistons and the operation link to switch the PTO selector valve.

2 Claims, 7 Drawing Sheets

SELECTOR VALVE OPERATING MECHANISM FOR WORKING VEHICLE

TECHNICAL FIELD

The present invention relates to a selector valve operating mechanism for a working vehicle which operates a mechanical selector valve thr controlling a hydraulic actuator.

BACKGROUND ART

Conventionally, an art is known in which a working vehicle such as a backhoe loader has a PTO hydraulic port for supplying pressure oil to a hydraulic actuator of an external hydraulic apparatus such as a breaker or a grapple, and for supply and discharge of pressure oil to the PTO hydraulic port, an electromagnetic type selector valve with an electromagnetic solenoid is employed such as an electromagnetic selector valve in which a spool in the selector valve is moved directly by an electromagnetic solenoid so as to change the route of pressure oil or an electromagnetic hydraulic selector valve in which an electromagnetic pilot valve having an electromagnetic solenoid is actuated and a main spool is moved indirectly by hydraulic pressure from the electromagnetic pilot valve so as to change the route of pressure oil (for example, see the Patent Literature 1).

On the other hand, such an electromagnetic type selector valve requires complex oil paths and control construction, and the large valve is employed so as to drive directly an external hydraulic apparatus. Therefore, when large numbers of the valves are employed, the cost of parts is increased. Accordingly, art of a mechanical selector valve is also known in which the spool of the selector valve is moved mechanically by manual power transmitted through a pedal, a lever or the like (for example, see the Patent Literature 2).

Patent Literature 1: the Japanese Patent Laid Open Gazette 2007-92763

Patent Literature 2: the Japanese Patent Laid Open Gazette 2003-176549

DISCLOSURE OF INVENTION

Problems to be Solved by the Invention

However, the structures of oil paths and switching control of a mechanical selector valve for controlling a hydraulic actuator and the cost of parts of the mechanical selector valve are respectively simplified and reduced to levels not achievable by an electromagnetic selector valve. However, simple and quick switching operation of the mechanical selector valve by the use of a nearby switch which requires small force to actuate such as the electromagnetic selector valve is difficult, and this makes the mechanical selector valve less easy to operate than the electromagnetic selector valve.

Means for Solving the Problems

The above problems are solved by the following means according to the present invention.

Namely, according to the present invention, a selector valve operating mechanism for a working vehicle which operates a mechanical selector valve for controlling a hydraulic actuator, includes a hydraulic piston connected through an operation link to a spool of the mechanical selector valve, an electromagnetic valve hydraulically controlling reciprocal action of the hydraulic piston, and a control device transmitting an action signal to the electromagnetic valve. By action control of the electromagnetic valve, the spool is moved via the hydraulic piston and the operation link so as to operate the mechanical selector valve.

According to the present invention, the hydraulic piston is constructed integrally with the electromagnetic valve.

According to the present invention, the hydraulic piston comprises two hydraulic pistons respectively for moving the spool forward and rearward in movement direction of the spool, and each of the hydraulic pistons is single acting type having a pressure oil chamber at only one of front and rear sides in the move direction of the piston.

According to the present invention, a selector valve operating mechanism for a working vehicle which operates a mechanical selector valve for controlling a hydraulic actuator, includes a motor connected through an operation link to a spool of the mechanical selector valve and controllable electrically, and a control device transmitting an action signal to the motor. The spool is moved via the operation link by rocking output of the motor so as to operate the mechanical selector valve.

Effect of the Invention

The present invention constructed as the above brings the following effects. Namely, according to the present invention, a selector valve operating mechanism for a working vehicle which operates a mechanical selector valve for controlling a hydraulic actuator, includes a hydraulic piston connected through an operation link to a spool of the mechanical selector valve, an electromagnetic valve hydraulically controlling reciprocal action of the hydraulic piston, and a control device transmitting an action signal to the electromagnetic valve. By action control of the electromagnetic valve, the spool is moved via the hydraulic piston and the operation link so as to operate the mechanical selector valve. Accordingly, the mechanical selector valve can be operated with the electromagnetic valve which is a small and cheap electromagnetic selector valve or the like. In comparison with the case of employing only a large and expensive electromagnetic selector valve, the oil path switching control construction can be simplified and the cost of parts thereof can be reduced. Furthermore, a nearby switch or the like is interlocked with the action of the electromagnetic valve so that the mechanical selector valve can be switched easily and quickly with small operation power similarly to the conventional electromagnetic selector valve, whereby switching operability can be improved widely. Moreover, the hydraulic pistons, the electromagnetic valve and the like can be subsequently attached easily to a current mechanical selector valve. Accordingly, the requirement of improvement of switching operability from a user can be measured quickly without changing the fundamental construction of the selector valve, whereby the working vehicle superior in general-purpose properties can be provided.

According to the present invention, the hydraulic piston is constructed integrally with the electromagnetic valve. Accordingly, the hydraulic pistons and the electromagnetic valve are made to be a single unit structure so as to be attachable and detachable easily in the selector valve operating mechanism, whereby the assemble ability and maintainability can be improved. Furthermore, members required for oil paths and attachment members concerning the hydraulic pistons and the electromagnetic valve can be made common, whereby the cost of parts can be reduced further. Moreover, the arrangement space for the hydraulic pistons and the electromagnetic valve can be reduced, whereby the whole selector valve operating mechanism can be made compact.

According to the present invention, the hydraulic piston comprises two hydraulic pistons respectively for moving the spool forward and rearward in movement direction of the spool, and each of the hydraulic pistons is single acting type having a pressure oil chamber at only one of front and rear sides in the move direction of the piston. Accordingly, unlike a double acting piston in which pressure oil chambers are provided at both front and rear sides in the move direction of the pistons, it is necessary to control only the hydraulic pressure in the pressure oil chamber at one of the sides and any complex position control mechanism for keeping the neutral position is not required, whereby the hydraulic pressure control construction can be simplified so as to improve responsibility of the pistons and to reduce the cost of parts further.

According to the present invention, a selector valve operating mechanism for a working vehicle which operates a mechanical selector valve for controlling a hydraulic actuator, includes a motor connected through an operation link to a spool of the mechanical selector valve and controllable electrically, and a control device transmitting an action signal to the motor. The spool is moved via the operation link by rocking output of the motor so as to operate the mechanical selector valve. Accordingly, the mechanical selector valve can be switched with a small and cheap motor. Therefore, in comparison with the case of employing only a large and expensive electromagnetic selector valve, the oil path switching control construction can be simplified and the cost of parts thereof can be reduced. Furthermore, a nearby switch or the like is interlocked with the action of the motor so that the mechanical selector valve can be switched easily and quickly with small operation power similarly to the conventional electromagnetic selector valve, whereby switching operability can be improved widely. Moreover, the motor and the like can be subsequently attached easily to a current mechanical selector valve, whereby the working vehicle superior in general-purpose properties can be provided. In comparison with the case that the small electromagnetic valve is employed for operating the mechanical selector valve, the hydraulic piping and the like can be reduced further, whereby the assemble ability and maintainability can be improved.

THE BEST MODE FOR CARRYING OUT THE INVENTION

Next, explanation will be given on an embodiment of the present invention.

Figure 1:
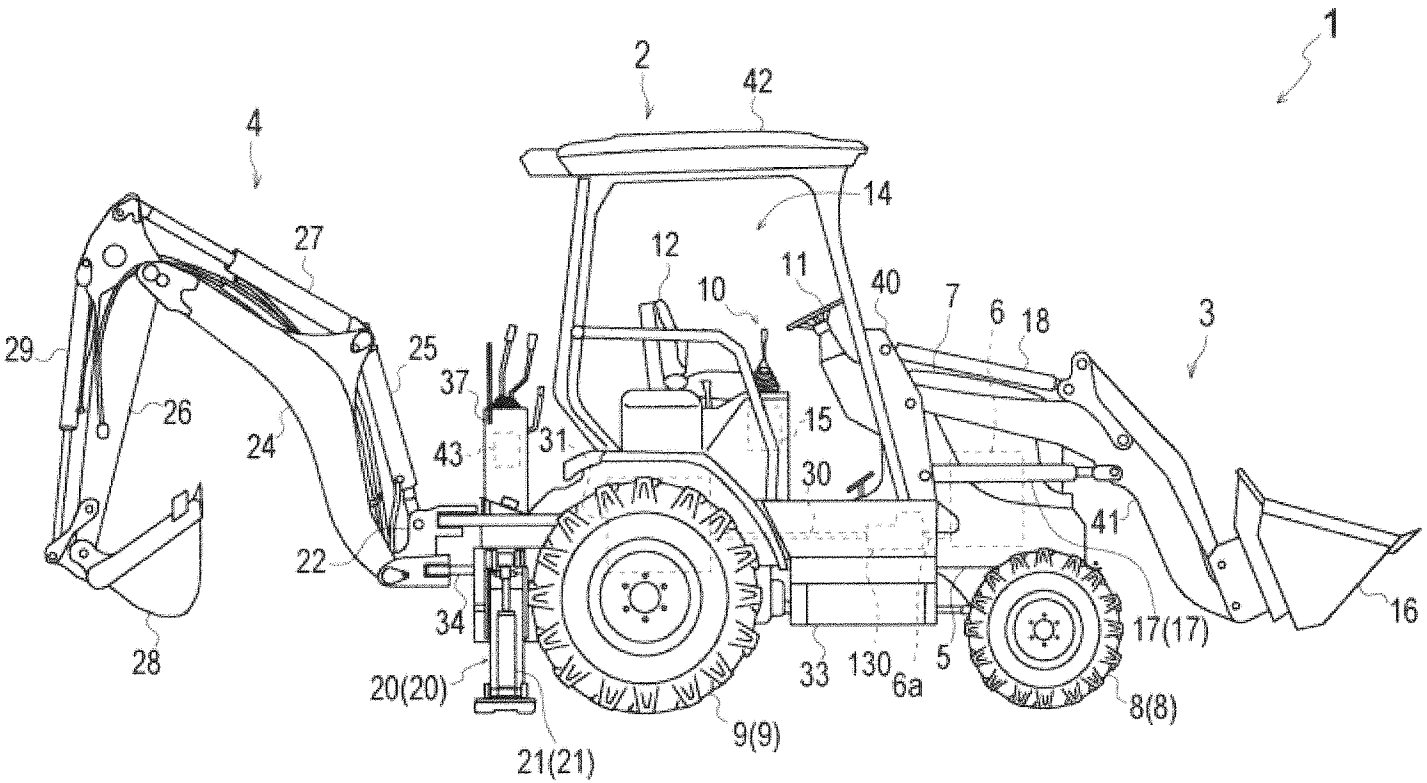
FIG. 1 is a side view of entire construction of a working vehicle according to the present invention.
Figure 2:
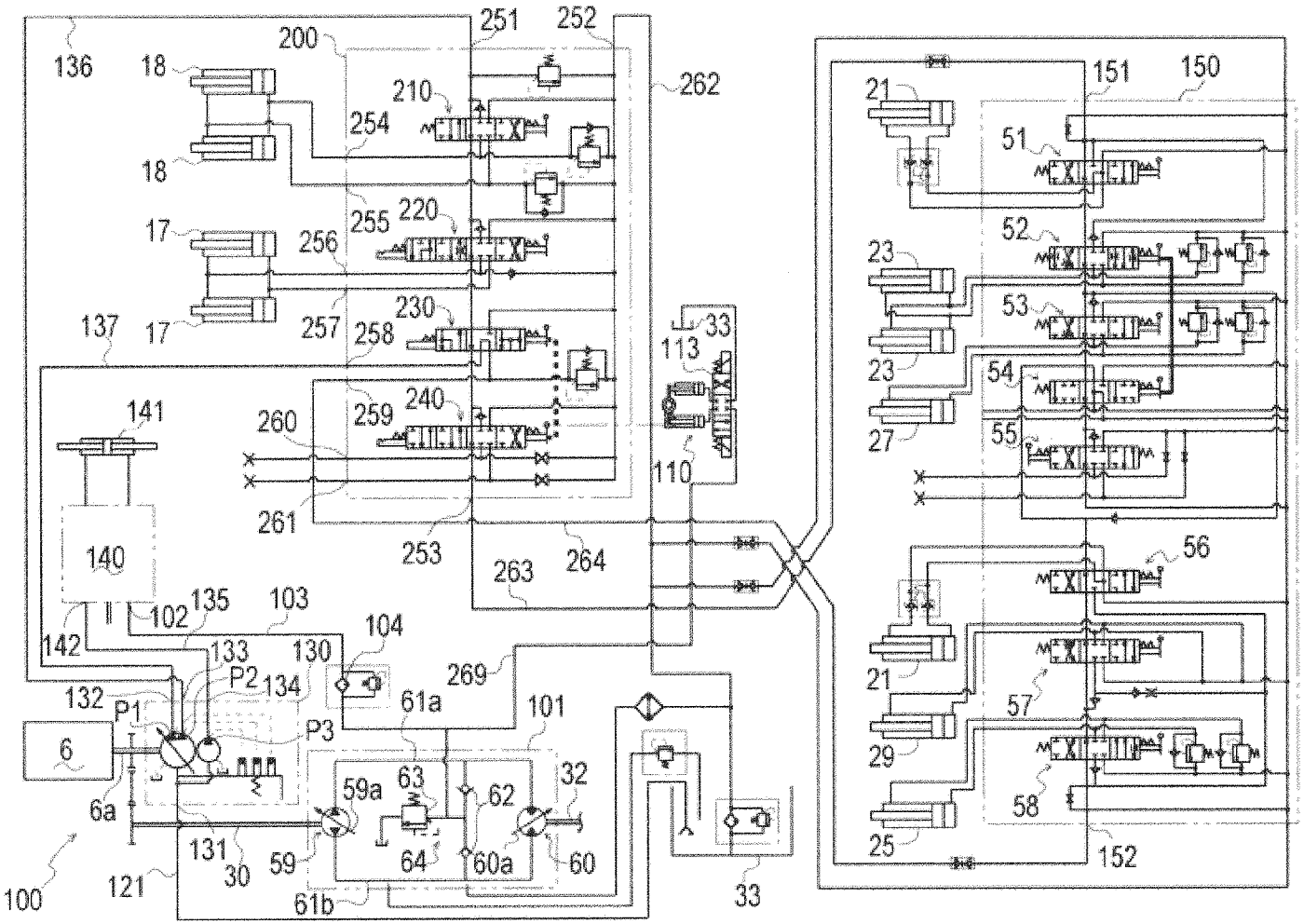
FIG. 2 is a hydraulic circuit diagram of the entire working vehicle.
Figure 3:
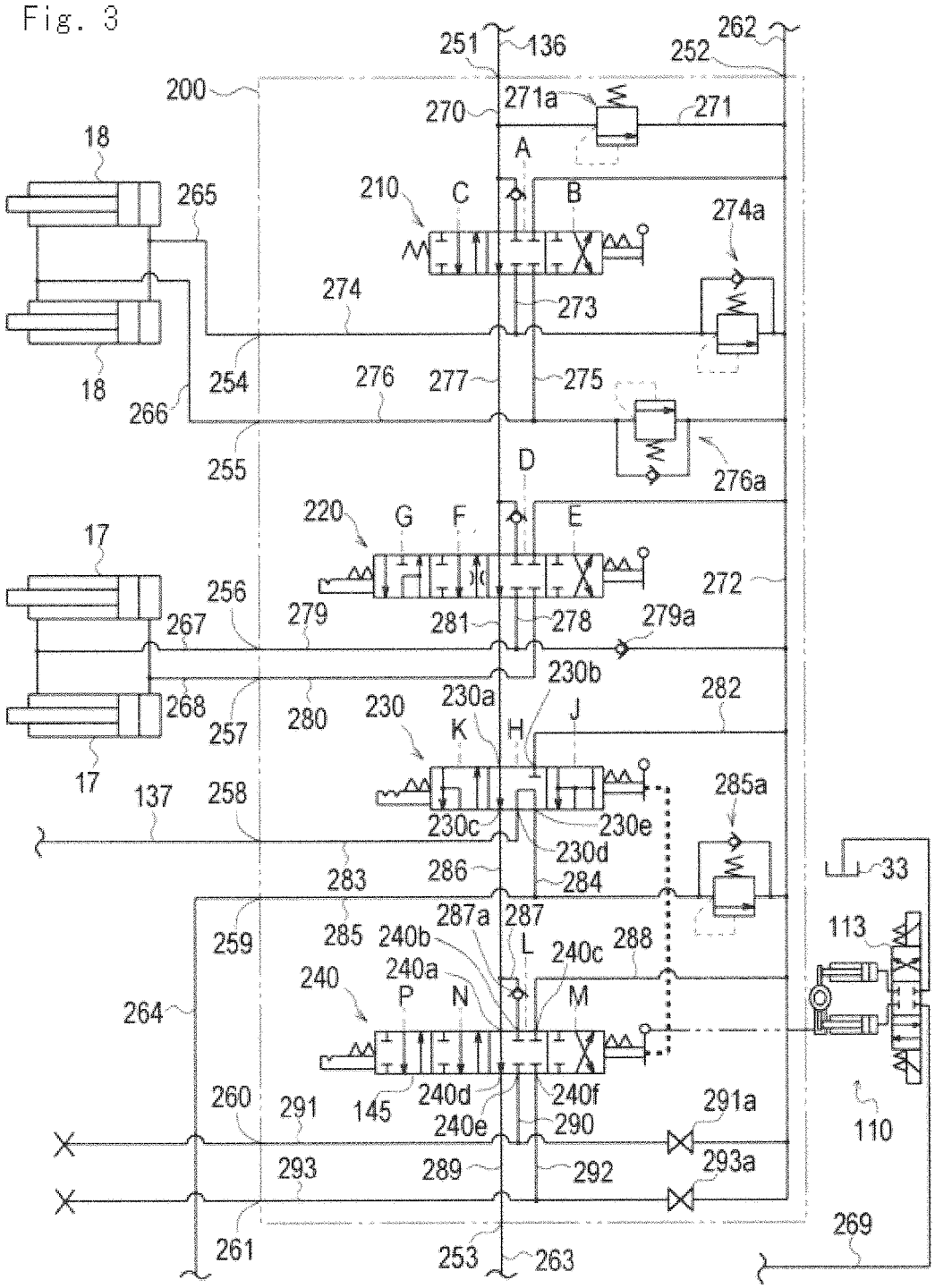
FIG. 3 is a hydraulic circuit diagram of a loader control valve section.
Figure 4:
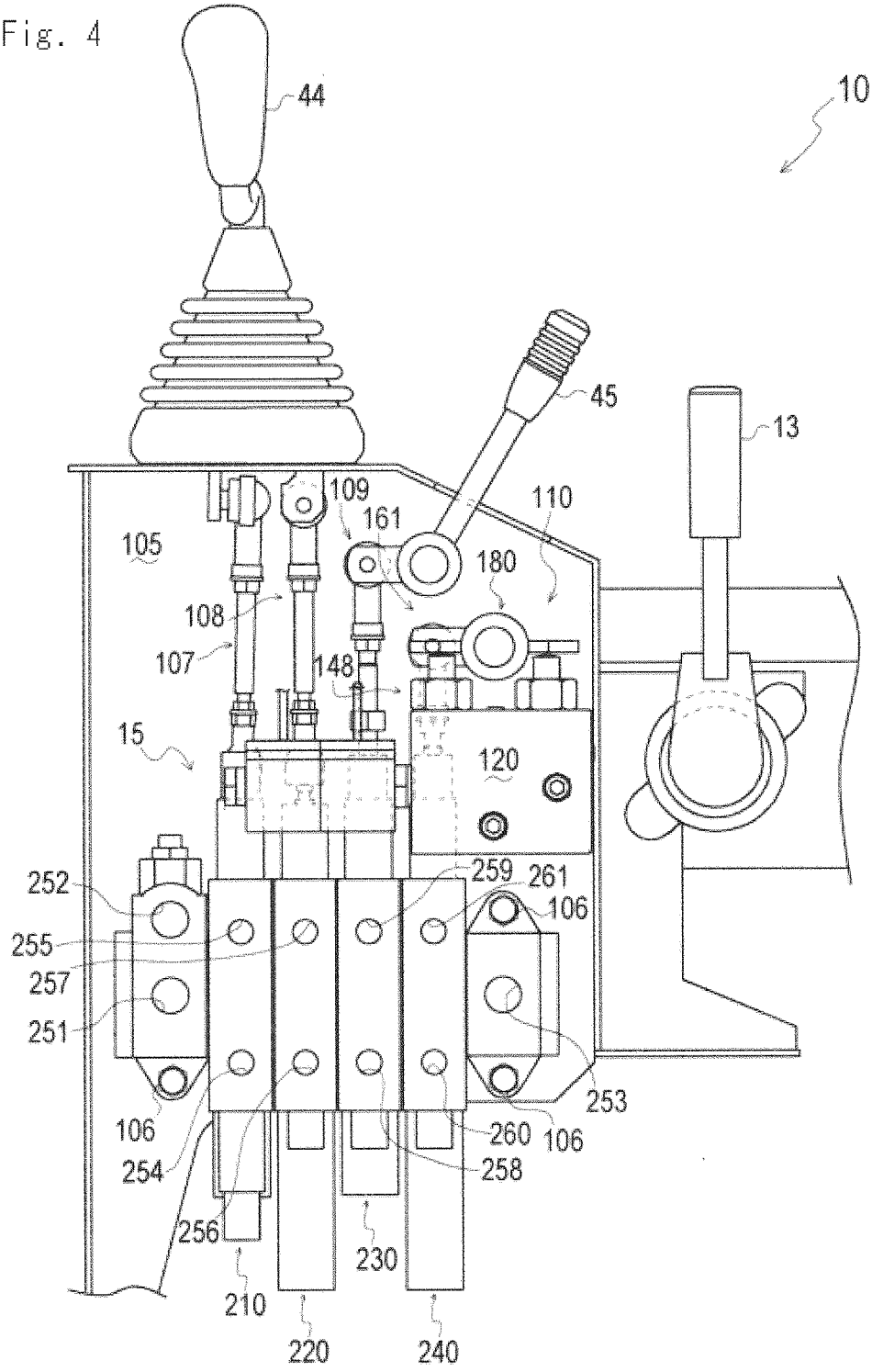
FIG. 4 is a front view partially in section of an operation part having a selector valve operating mechanism according to the present invention.
Figure 5:
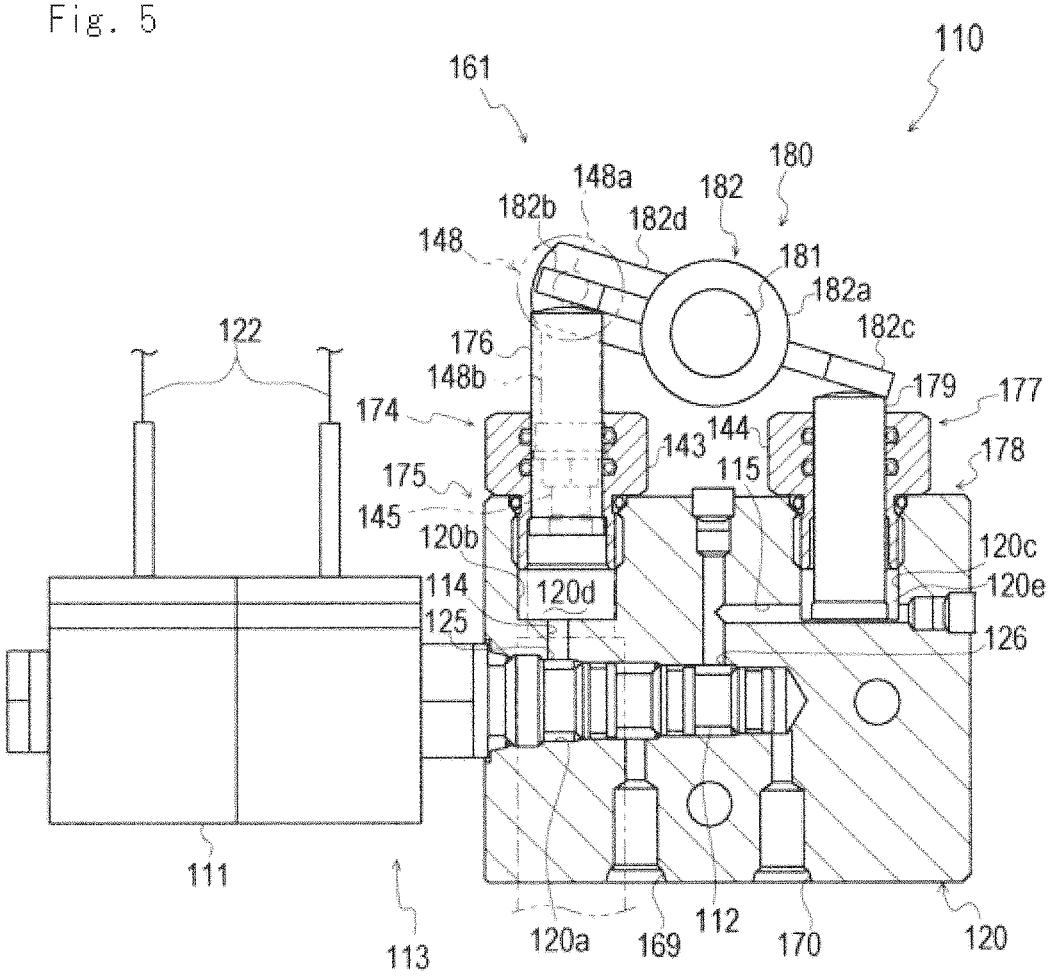
FIG. 5 is a front view partially in section of the selector valve operating mechanism.
Figure 6:
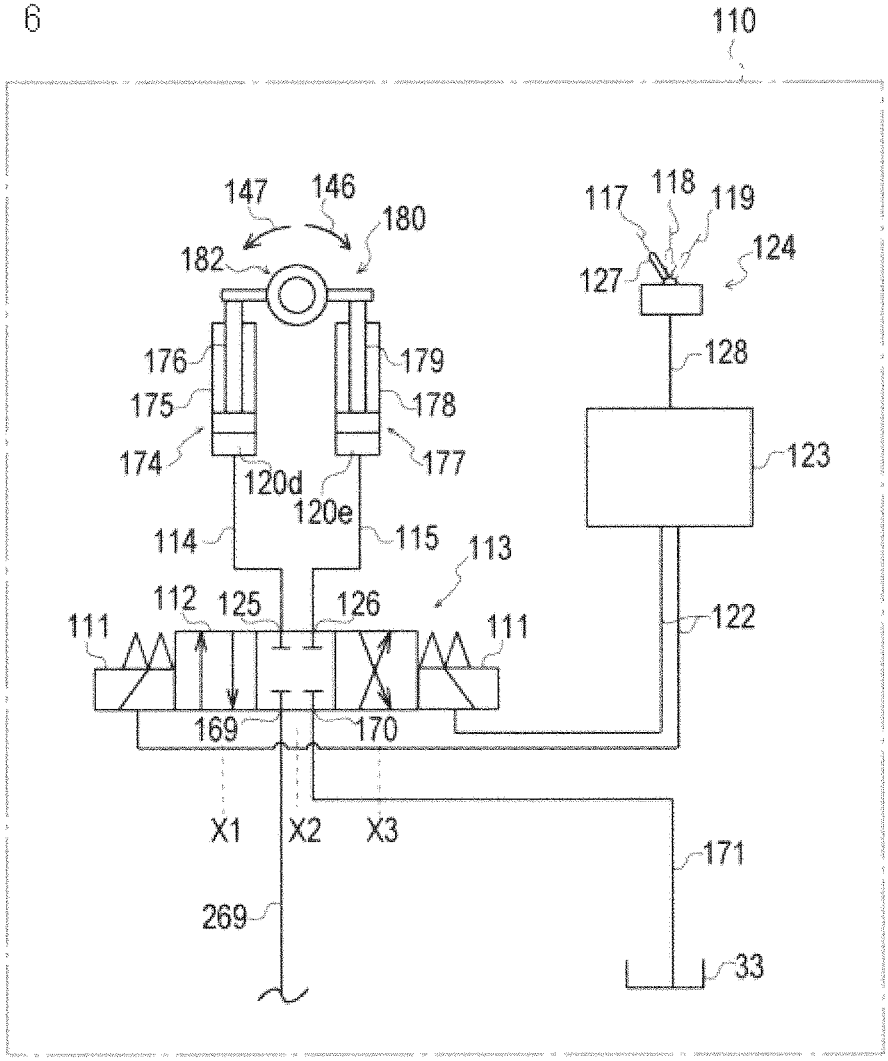
FIG. 6 is a hydraulic circuit diagram of the selector valve operating mechanism.
Figure 7:
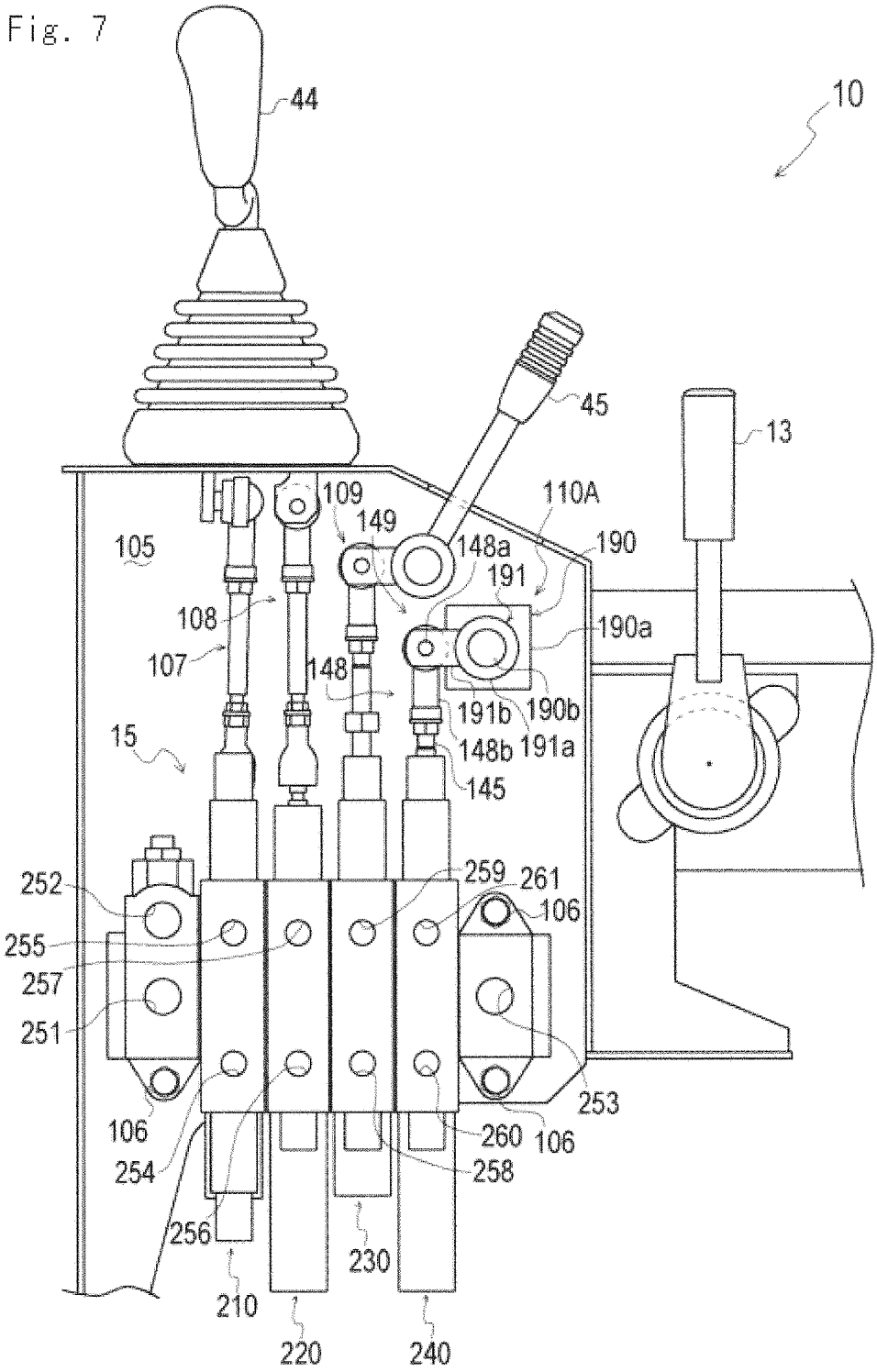
FIG. 7 is a front view partially in section of an operation part having a selector valve operating mechanism of another embodiment.

FIG. 1 is a side view of entire construction of a working vehicle according to the present invention. FIG. 2 is a hydraulic circuit diagram of the entire working vehicle. FIG. 3 is a hydraulic circuit diagram of a loader control valve section. FIG. 4 is a front view partially in section of an operation part having a selector valve operating mechanism according to the present invention. FIG. 5 is a front view partially in section of the selector valve operating mechanism. FIG. 6 is a hydraulic circuit diagram of the selector valve operating mechanism. FIG. 7 is a front view partially in section of an operation part having a selector valve operating mechanism of another embodiment.

Firstly, explanation will be given on entire construction of a working vehicle 1 according to the present invention referring to FIGS. 1, 2 and 4.

The working vehicle 1 is a backhoe loader. A loader 3 which is a loading unit and an excavator 4 are disposed at front and rear sides of a traveling vehicle 2 at the center of the working vehicle 1. A body frame 5 is extended and provided from the front end to the real end of the traveling vehicle 2. Left and right front wheels 8 and rear wheels 9 are attached respectively through a front axle casing and a rear axle casing (not shown) to the front and rear portions of the body frame 5. The working vehicle 1 can travel while equipped with the loader 3 and the excavator 4.

A steering wheel 11 and a seat 12 are disposed in a maneuvering part 14 covered by a canopy 42 in the traveling vehicle 2. Various kinds of hydraulic operation members for controlling the loader 3 and the like, a meter (not shown) and the like are concentrically arranged at the side of the seat 12 as an operation part 10. An accelerator lever 13, a control valve unit 15 having a plurality of mechanical selector valves according to the present invention, and the like are arranged in the operation part 10. Accordingly, traveling operation of the working vehicle 1 and loader work operation of the loader 3 can be performed by the maneuvering part 14.

The loader 3 is connected to the side portion of the traveling vehicle 2 and extended forward, and includes a bracket 40, a lift arm 41, a bucket 16 attached to the tip of the lift arm 41 and the like so as to be employed as a front loader. An engine 6 is mounted in the front portion of the body frame 5 of the traveling vehicle 2. The engine 6 is covered by a bonnet 7 on the body frame 5, and the loader 3 is disposed outside the bonnet 7.

The excavator 4 is detachably attached to the rear portion of the traveling vehicle 2 and includes a boom bracket 22, a boom 24, an arm 26, a bucket 28 attached to the tip of the arm 26 and the like so as to be employed as a backhoe. Behind the seat 12, an operation column 37 containing a control valve unit 43 for the excavator 4 is standingly provided, and excavating work operation can be performed by operating an operation lever on the operation column 37.

Two stabilizers 20 are disposed at the left and right sides of the rear portion of the body frame 5. By extending and contracting rods of two stabilizer cylinders 21 provided in the stabilizers 20, at the excavating work, the excavator 4 can be moved vertically and rotated, and the stabilizers 20 can be stretched with the bucket 16 of the loader 3 so as to support the working vehicle 1, thereby securing good stability of the vehicle body.

At the side of the maneuvering part 14, a pressure oil tank 33 serving as a reservoir tank of pressure oil is disposed. Behind the engine 6, a hydraulic pump unit 130 for supplying pressure oil to working machines such as the loader 3 and the excavator 4 is disposed. An output shaft **6*a* projected rearward from the engine 6 is connected to the hydraulic pump unit 130 and the hydraulic pump unit 130 is driven by power of the engine, whereby pressure oil is supplied from the hydraulic pump unit 130** to the working machines and the like.

In detail, in the loader 3, pressure oil is supplied to left and right lift cylinders 17 and dump cylinders 18, and in the excavator 4, pressure oil is supplied to two swing cylinder 23, which makes extend and contract a boom cylinder 25, an arm cylinder 27, a bucket cylinder 29 and a rod 34 so as to rotate laterally the excavator 4, and the left and right stabilizer cylinders 21. Furthermore, pressure oil is supplied to a power steering cylinder 141 for steering the front wheels 8.

A hydraulic stepless transmission 101 in a transmission casing 31 is connected through a transmission shaft 30 and the like to the output shaft 6*a* of the engine 6. A motor shaft 32 which is an output shaft of the hydraulic stepless transmission 101 is connected through a differential mechanism, a clutch mechanism, axles and the like (not shown) to the rear wheels 9. The power of the engine is speed-changed and then transmitted as speed-changed power to the rear wheels 9, whereby the working vehicle 1 is driven so as to travel.

Next, explanation will be given on a hydraulic circuit 100 of the working vehicle 1 referring to FIGS. 2 and 3.

The hydraulic circuit 100 includes the hydraulic stepless transmission 101, the pressure oil tank 33, the hydraulic pump unit 130, a power steering control valve section 140, a loader control valve section 200 which is a mechanical selector valve group form controlling the loader 3, a backhoe control valve section 150 which is a mechanical selector valve group form controlling the excavator 4, and the like.

In the hydraulic stepless transmission 101, a hydraulic pump 59 and a hydraulic motor 60 each of which is variable capacity type are connected fluidly to each other through a pair of main oil paths 61*a* and 61*b* so as to construct a closed circuit. In the closed circuit, by controlling tilt angle of movable swash plates 59*a* and 60*a* of the hydraulic pump 59 and the hydraulic motor 60, the rotational speed and rotational direction of the power of the engine inputted through the transmission shaft 30 and the like to the hydraulic pump 59 is changed freely, and then outputted as speed-changed power through the motor shaft 32.

The pressure oil tank 33 is a vessel in which pressure oil used in the hydraulic circuit 100 is stored, and may also serve as the transmission casing 31 of the working vehicle 1 at need.

The hydraulic pump unit 130 includes two variable capacity type hydraulic pumps P1 and P2 and a fixed capacity type hydraulic pump P3 such as a gear pump. The hydraulic pumps P1 and P2 are constructed integrally so that the mounting space of the hydraulic pump unit 130 is reduced in comparison with the case that hydraulic pumps are provided separately, whereby the hydraulic pump unit 130 is made compact.

The suction side of each of the hydraulic pumps P1, P2 and P3 is connected to a port 131, and the port 131 is connected through a pipe 121 to the pressure oil tank 33. Namely, pressure oil is supplied through the common pipe 121 to the hydraulic pumps P1, P2 and P3, whereby the introduction route of pressure oil is simplified so as to reduce piping cost and suction resistance at the time of suction of pressure oil is reduced.

Furthermore, the discharge sides of the hydraulic pumps P1, P2 and P3 respectively have discharge ports 132, 133 and 134. The discharge ports 132 and 133 are connected to the loader control valve section 200 respectively through pipes 137 and 136, and the discharge port 134 is connected through a pipe 135 to the power steering control valve section 140.

Accordingly, in the hydraulic pump unit 130, pressure oil in the pressure oil tank 33 is sucked through the pipe 121 and the port 131 and supplied through the discharge ports 132, 133 and 134 to the loader control valve section 200 and the power steering control valve section 140.

In the power steering control valve section 140, a steering control valve (not shown) is provided, and the steering control valve controls slide of the power steering cylinder 141 corresponding to the operation of the steering wheel 11 so as to assist the steering power. The pipe 135 is connected to a port 142 provided in the power steering control valve section 140, and pressure oil discharged from the hydraulic pump P3 is supplied from the pipe 135 through the port 142 to the steering control valve.

A port 102 provided in the power steering control valve section 140 is connected through a pipe 103 whose middle portion is provided therein with a filter 104 to a charge circuit 64 of the hydraulic stepless transmission 101. The charge circuit 64 includes two check valves 62 and a check release valve 63, and pressure oil controlled to charge release pressure by the check release valve 63 is supplied through the check valves 62 to the closed circuit.

As described in detail later, the loader control valve section 200 includes selector valves 210, 220, 230 and 240 controlling pressure oil to the lift cylinders 17 and the dump cylinders 18 of the loader 3, and the drive of the loader 3 is controlled by the selector valves 210, 220, 230 and 240.

Furthermore, the loader control valve section 200 includes a pump port 251, a tank port 252, a carry-over port 253, dump cylinder ports 254 and 255, lift cylinder ports 256 and 257, ports 258 and 259, and PTO ports 260 and 261.

The pump port 251 is connected to a pipe 136 communicated with the discharge port 133 of the hydraulic pump P2, the port 258 is connected to a pipe 137 communicated with the discharge port 132 of the hydraulic pump P1, and the tank port 252 is connected to a pipe 262 communicated with the pressure oil tank 33. Pressure oil discharged from the hydraulic pumps P1 and P2 is supplied to the selector valves 210, 220, 230 and 240 of the loader control valve section 200, whereby the lift cylinders 17, the dump cylinders 18, a hydraulic actuator of an external hydraulic apparatus and the like are driven.

The backhoe control valve section 150 includes selector valves 51 to 58, which control the action of the stabilizer cylinders 21, the swing cylinder 23, the boom cylinder 25, the arm cylinder 27 and the bucket cylinder 29, and ports 151 and 152.

The port 151 is connected to a pipe 263 communicated with the carry-over port 253 of the loader control valve section 200, and the port 152 is connected to a pipe 264 communicated with the port 259 of the loader control valve section 200. One of the stabilizer cylinders 21, the swing cylinder 23 and the arm cylinder 27 are driven by pressure oil supplied from the port 151 through the pipe 263, and the other stabilizer cylinder 21, the bucket cylinder 29 and the boom cylinder 25 are driven by pressure oil supplied from the port 152 through the pipe 264.

Next, explanation will be given on detailed construction of the loader control valve section 200 referring to FIGS. 2 and 3.

The loader control valve section 200 includes the dump cylinder selector valve 210, the lift cylinder selector valve 220, the mode selector valve 230 and the PTO selector valve 240.

The dump cylinder selector valve 210 is a direction control valve with six ports and three positions (positions A, B and C) and interposed between the pump port 251 and the dump cylinders 18. The pump port 251 and the dump cylinder selector valve 210 are connected through an oil path 270. The oil path 270 and an oil path 272 connected to the tank port 252 are connected through an oil path 271. A release valve 271*a* is provided in the middle portion of the oil path 271.

Furthermore, the oil path 272 and the dump cylinder port 254 are connected through an oil path 274. The middle portion of the oil path 274 is connected through an oil path 273 to the dump cylinder selector valve 210. An anti-void release valve 274*a* is provided in the oil path 274 near the connection part to the oil path 272. The oil path 272 and the dump cylinder port 255 are connected through an oil path 276. The middle portion of the oil path 276 is connected through an oil path 275 to the dump cylinder selector valve 210. An anti-void release valve 276*a* is provided in the oil path 276 near the connection part to the oil path 272.

The dump cylinder port 254 is communicated through a pipe 265 with bottom chambers of the dump cylinders 18. The dump cylinder port 255 is communicated through a pipe 266 with rod chambers of the dump cylinders 18.

In this construction, pressure oil discharged from the discharge port 133 of the hydraulic pump P2 is supplied through the pipe 136, the pump port 251 and the oil path 270 to the dump cylinder selector valve 210. When the dump cylinder selector valve 210 is switched to the position C, pressure oil is pressingly sent through the oil path 273, the oil path 274, the dump cylinder port 254 and the pipe 265 to the bottom chambers of the dump cylinders 18. Accordingly, the rods of the dump cylinders 18 are extended.

When the dump cylinder selector valve 210 is switched to the position B, pressure oil is pressingly sent through the oil path 275, the oil path 276, the dump cylinder port 255 and the pipe 266 to the rod chambers of the dump cylinders 18. Accordingly, the rods of the dump cylinders 18 are contracted. By the position selecting operation of the dump cylinder selector valve 210, the rods of the dump cylinders 18 are extended and contracted, whereby the bucket 16 is rotated vertically about the lift arm 41.

The lift cylinder selector valve 220 is a direction control valve with six ports and four positions (positions D, E, F and G) and interposed between the dump cylinder selector valve 210 and the lift cylinders 17. The lift cylinder selector valve 220 is connected through an oil path 277 to the dump cylinder selector valve 210.

Furthermore, the oil path 272 and the lift cylinder port 256 are connected through an oil path 279. The middle portion of the oil path 279 is connected through an oil path 278 to the lift cylinder selector valve 220. A check valve 279*a* is provided in the oil path 279 near the connection part to the oil path 272. The lift cylinder selector valve 220 and the lift cylinder port 257 are connected through an oil path 280.

The lift cylinder port 256 is communicated through a pipe 267 with rod chambers of the lift cylinders 17. The lift cylinder port 257 is communicated through a pipe 268 with bottom chambers of the lift cylinders 17.

In this construction, when the dump cylinder selector valve 210 is switched to the position A, pressure oil passing through the dump cylinder selector valve 210 is supplied through the oil path 277 to the lift cylinder selector valve 220. Furthermore, when the lift cylinder selector valve 220 is switched to the position E, pressure oil is pressingly sent through the oil path 280, the lift cylinder port 257 and the pipe 268 to the bottom chambers of the lift cylinders 17. Accordingly, the rods of the lift cylinders 17 are extended.

When the lift cylinder selector valve 220 is switched to the position F, pressure oil is pressingly sent through the oil path 278, the oil path 279, the lift cylinder port 256 and the pipe 267 to the rod chambers of the lift cylinders 17. Accordingly, the rods of the lift cylinders 17 are contracted. By the position selecting operation of the lift cylinder selector valve 220, the rods of the lift cylinders 17 are extended and contracted, whereby the lift arm 41 is moved upward and downward vertically.

The mode selector valve 230 is a direction control valve with five ports and three positions (positions J, K and L) and interposed between the lift cylinder selector valve 220 and the carry-over port 253. The mode selector valve 230 includes primary ports 230*a* and 230*b* and secondary ports 230*c*, 230*d* and 230*e*. When the mode selector valve 230 is switched to the "working position H", the port 230*a* is communicated with the port 230*c*, the port 230*d* is communicated with the port 230*e*, and the port 230*b* is blocked. When the mode selector valve 230 is switched to the "return position J", the port 230*a*, the port 230*b*, the port 230*c*, the port 230*d* and the port 230*e* are communicated with each other. When the mode selector valve 230 is switched to the "confluence position K", the port 230*a* is communicated with the port 230*c* and the port 230*d* and the port 230*b* is communicated with the port 230*e*. The port 230*a* is connected through an oil path 281 to the lift cylinder selector valve 220.

Furthermore, the port 230*b* of the mode selector valve 230 is connected through an oil path 282 to the oil path 272. The port 230*d* is connected through an oil path 283 to the port 258. The port 230*e* is connected through an oil path 284 to a middle portion of an oil path 285. The oil path 285 connects the oil path 272 to the port 259. An anti-void release valve 285*a* is provided in the oil path 285 near the connection part to the oil path 272.

The PTO selector valve 240 is a direction control valve with six ports and four positions (positions L, M, N and P) and interposed between the mode selector valve 230 and the carry-over port 253. The PTO selector valve 240 includes primary ports 240*a*, 240*b* and 240*c* and secondary ports 240*d*, 240*e* and 240*f*. When the PTO selector valve 240 is switched to the "position L", the port 240*a* is communicated with the port 240*d* and the ports 240*b*, 240*c*, 240*e* and 240*f* are blocked. When the PTO selector valve 240 is switched to the "position M", the port 240*b* is communicated with the port 240*f*, the port 240*c* is communicated with the port 240*e* and the ports 240*a* and 240*d* are blocked. When the PTO selector valve 240 is switched to the "position N", the port 240*b* is communicated with the port 240*e*, the port 240*c* is communicated with the port 240*f* and the ports 240*a* and 240*d* are blocked. When the PTO selector valve 240 is switched to the "continuous position P", the port 240*b* is communicated with the port 240*e*, the port 240*c* is communicated with the port 240*f* and the ports 240*a* and 240*d* are blocked. The port 240*a* is connected through an oil path 286 to the port 230*c* of the mode selector valve 230.

Furthermore, the port 240*b* of the PTO selector valve 240 is connected through an oil path 287 to the middle portion of the oil path 286, and a check valve 287*a* is provided in the middle portion of the oil path 287. The port 240*c* is connected through an oil path 288 to the oil path 272. The port 240*d* is connected through an oil path 289 to the carry-over port 253. The port 240*e* is connected through an oil path 290 to a middle portion of an oil path 291. The oil path 291 connects the oil path 272 to the PTO port 260. A plug 291*a* is provided in the oil path 291 near the connection part to the oil path 272. The port 240*f* is connected through an oil path 292 to a middle portion of an oil path 293. The oil path 293 connects the oil path 272 to the PTO port 261. A plug 293*a* is provided in the oil path 293 near the connection part to the oil path 272.

Explanation will be given on selection construction of the pressure oil route with the mode selector valve 230 and the PTO selector valve 240 constructed as mentioned above.

When excavating work or the like is performed with the excavator 4, the mode selector valve 230 is set to the working position H and the PTO selector valve 240 is set to the position L.

Then, pressure oil discharged from the discharge port 133 of the hydraulic pump P2 is supplied through the pipe 136, the pump port 251, the oil path 270, the dump cylinder selector valve 210, the oil path 277, the bucket lift cylinder selector valve 220, the oil path 281, the mode selector valve 230, the oil paths 286, the PTO selector valve 240, the oil path 289, the carry-over port 253, and the pipe 263 to the backhoe control valve section 150. On the other hand, pressure oil discharged from the discharge port 132 of the hydraulic pump P1 is supplied through the pipe 137, the port 258, the oil path 283, the mode selector valve 230, the oil path 284, the oil path 285, the port 259 and the pipe 264 to the backhoe control valve section 150. Accordingly, pressure oil pressingly sent from the discharge ports 132 and 133 of the hydraulic pumps P1 and P2 can be supplied to the backhoe control valve section 150, and the excavator 4 is driven by the supplied pressure oil.

In the case that an external hydraulic apparatus is connected to the PTO ports 260 and 261 and work is performed with the external hydraulic apparatus, the mode selector valve 230 is set to the working position H and the PTO selector valve 240 is set to the position M or N.

Then, pressure oil discharged from the discharge port 133 of the hydraulic pump P2 is supplied through the pipe 136, the pump port 251, the oil path 270, the dump cylinder selector valve 210, the oil, path 277, the bucket lift cylinder selector valve 220, the oil, path 281, the mode selector valve 230, and the oil paths 286 and 287 to the PTO selector valve 240. At the position M, the pressure oil is pressingly sent through the port 240*f* and the oil paths 292 and 293 to the PTO port 261. At the position N, the pressure oil is pressingly sent through the port 240*e* and the oil paths 290 and 291 to the PTO port 260. Accordingly, the pressure oil is extracted from the PTO port 260 or 261 so as to drive the external hydraulic apparatus.

In the case of conveying work of earth and sand with the loader 3 or the case of traveling, the mode selector valve 230 is set to the return position J.

Then, pressure oil discharged from the discharge port 133 of the hydraulic pump P2 is supplied through the pipe 136, the pump port 251 and the oil path 270 to the dump cylinder selector valve 210, and is supplied through the oil path 277 to the bucket lift cylinder selector valve 220 so as to drive the loader 3.

The pressure oil after passing through the dump cylinder selector valve 210 and the bucket lift cylinder selector valve 220 is supplied through the oil path 281 to the mode selector valve 230. On the other hand, pressure oil discharged from the discharge port 132 of the hydraulic pump P1 is supplied through the pipe 137, the port 258 and the oil path 283 to the mode selector valve 230. The pressure oil supplied from the discharge ports 132 and 133 of the hydraulic pumps P1 and P2 is returned through the oil path 282, the oil path 272, the tank port 252 and the pipe 262 to the pressure oil tank 33.

In the case that the external hydraulic apparatus connected to the PTO ports 260 and 261 requires larger flow rate than the flow rate of pressure oil discharged from the discharge port 133 of the hydraulic pump P2, the mode selector valve 230 is set to the confluence position K and the PTO selector valve 240 is set to the continuous position P.

Then, pressure oil discharged from the discharge port 133 of the hydraulic pump P2 is supplied through the pipe 136, the pump port 251, the oil path 270, the dump cylinder selector valve 210, the oil path 277, the bucket lift cylinder selector valve 220, and the oil path 281 to the mode selector valve 230. On the other hand, pressure oil discharged from the discharge port 132 of the hydraulic pump P1 is supplied through the pipe 137, the port 258 and the oil path 283 to the mode selector valve 230. Pressure oil supplied from the discharge ports 132 and 133 of the hydraulic pumps P1 and P2 is combined in the mode selector valve 230, and the combined pressure oil is pressingly sent through the oil paths 286, the oil paths 287, the PTO selector valve 240, the oil path 290, the oil path 291 and the PTO port 260 to the external hydraulic apparatus so as to drive it.

Next, explanation will be given on the control valve unit 15 constructing the loader control valve section 200 referring to FIGS. 2 to 4.

As mentioned above, the control valve unit 15 is disposed in the operation part 10 and fixed to a vertical wall surface of an operation frame 105 constructing the frame body of the operation part 10 by a fastening member 106 such as a bolt.

In the left portion of the control valve unit 15, the tank port 252 and the pump port 251 are provided respectively in the upper and lower sides of the portion, and the selector valves 210, 220, 230 and 240 are connected in series rightward so that the spool of each selector valve is slidable vertically. In the right portion of the PTO selector valve 240 at the most right, the carry-over port 253 is disposed.

In the lower and upper portions of the side surfaces of the selector valves 210, 220, 230 and 240, the dump cylinder ports 255 and 254, the lift cylinder ports 257 and 256, the ports 259 and 258, and the PTO ports 261 and 260 connected to hydraulic actuators of an external hydraulic apparatus are respectively formed.

Ones of ends of the spool of each of the dump cylinder selector valve 210 and the bucket lift cylinder selector valve 220 are interlockingly connected to a loader operation lever 44 respectively through links 107 and 108. By slewing the loader operation lever 44, the clump cylinder selector valve 210 and the bucket lift cylinder selector valve 220 are switched to the positions, whereby the rods of the dump cylinders 18 and the lift cylinders 17 are extended and contracted as mentioned above so as to drive the loader 3.

One of ends of the spool of the mode selector valve 230 is interlockingly connected through a link 109 to a mode selector lever 45. By slewing the mode selector lever 45, the mode selector valve 230 can be switched to one of the working position H, the return position J and the confluence position K. Similarly, one of ends of the spool of the PTO selector valve 240 is interlockingly connected to a selector valve operating mechanism 110 according to the present invention. By operation means such as a nearby switch 124 discussed later, the spool 145 of the PTO selector valve 240 can be slid easily and quickly so as to switch to one of the positions L, M, N and P. By combining the set positions of the mode selector valve 230 and the spool of the PTO selector valve 240, the pressure oil route can be switched as mentioned above so as to perform various kinds of work.

Next, explanation will be given on the selector valve operating mechanism 110 referring to FIGS. 2 to 6.

The selector valve operating mechanism 110 includes a solenoid valve 113 having a spool 112 driven by electromagnetic solenoids 111, a pair of operating actuators 174 and 177 connected to the solenoid valve 113 respectively through oil paths 114 and 115, an operation link 161 and the like. The operation link 161 includes a rocking part 180 rockingly driven by the operating actuators 174 and 177 and a connection part 148 interlockingly connecting the rocking part 180 to one of ends of the spool 145 of the PTO selector valve 240.

The solenoid valve 113 has four ports and three positions. The spool 112 connected to the two electromagnetic solenoids 111 is formed to be inserted into a spool chamber 120*a* of a valve block 120, which is arranged closely to the control valve unit 15, from the side thereof. The electromagnetic solenoids 111 are connected through two wires 122 to a controller 123 controlling the traveling operation and various kinds of work, and the controller 123 is connected through a wire 128 to the nearby switch 124 provided in the operation part 10. The nearby switch 124 should be provided in a position easy to be operated such as the grip of the loader operation lever 44 or the upper surface of the operation frame 105, and the attachment position is not limited.

Furthermore, a pump port 169 opened in the lower surface of the valve block 120 is connected through a pipe 269 to the portion of the pipe 103 between the power steering control valve section 140 and the hydraulic stepless transmission 101 closer more the hydraulic stepless transmission 101 than the filter 104, whereby a part of pressure oil discharged from the discharge port 134 of the hydraulic pump P3 is supplied through the pipe 269 to the selector valve operating mechanism 110.

In this case, the pipe 269 is connected to the charge circuit 64 of the hydraulic stepless transmission 101 similarly to the pipe 103, whereby pressure oil controlled to charge release pressure by the check release valve 63 is supplied through the pipe 269 to the solenoid valve 113. On the other hand, a tank port 170 formed in the lower surface of the valve block 120 adjacently to the pump port 169 is connected through a pipe 171 to the pressure oil tank 33, whereby pressure oil from the solenoid valve 113 can be discharged to the pressure oil tank 33.

The operating actuator 174 includes an operating cylinder 175, including a cylinder chamber 120*b* opened upward in the upper portion of the valve block 120 and a plug 143 engaged downward with the cylinder chamber 120*b*, and an operating piston 176 slidably inserted downward into the operating cylinder 175. A pressure oil chamber 120*d* is provided in the cylinder chamber 120*b* at the side of lower end of the operating piston 176, and the pressure oil chamber 120*d* is connected through the oil path 114 to one of actuator ports 125 of the solenoid valve 113.

Similarly, the operating actuator 177 includes an operating cylinder 178, including a cylinder chamber 120*c* arranged adjacently to the cylinder chamber 120*b* and a plug 144 engaged downward with the cylinder chamber 120*c*, and an operating piston 179 slidably inserted downward into the operating cylinder 178. A pressure oil chamber 120*e* is provided in the cylinder chamber 120*c* at the side of lower end of the operating piston 179, and the pressure oil chamber 120*e* is connected through the oil path 115 to the other actuator port 126 of the solenoid valve 113. Each of the operating pistons 176 and 179 is formed integrally with the solenoid valve 113 via the valve block 120.

Accordingly, in the valve block 120, pressure oil from the solenoid valve 113 is supplied to and discharged from the pressure oil chambers 120*d* and 120*e* of the operating actuators 174 and 177. By the hydraulic pressure of the oil, the operating pistons 176 and 179 can be slid vertically in the operating cylinders 175 and 178.

In the operation link 161, the rocking part 180 includes a spindle 181, projectingly provided horizontally from the vertical wall surface of the operation frame 105 toward a space above the valve block 120 and between the operating actuators 174 and 177, and a rocking body 182 rotatably engaged around the spindle 181 by a boss 182*a*.

In the rocking body 182, backing plates 182*b* and 182*c* are projectingly provided radially at the positions on the outer perimeter of the boss 182*a* separated for 180°, and the lower surfaces of the backing plates 182*b* and 182*c* touch respectively the tops of the operating pistons 176 and 179. On the other hand, a pressing plate 182*d* is projectingly provided radially at the part on the outer perimeter of the boss 182*a* closer to the control valve unit 15 than the backing plate 182*b*.

An upper end of a connection stay 148*b* constructing the connection part 148 is rotatably connected through a connection shaft 148*a* to the pressing plate 182*d*, and the lower end of the connection stay 148*b* is connected to the outer upper end of the spool 145 of the PTO selector valve 240.

Accordingly, when the operating pistons 176 and 179 of the operating actuators 174 and 177 are slid vertically, the backing plates 182*b* and 182*c* of the rocking part 180 are pushed so that the rocking body 182 is rotated around the spindle 181. Subsequently, the spool 145 of the PTO selector valve 240 is moved vertically via the pressing plate 182*d* and the connection part 148.

In the construction as mentioned above, by stewing a switch lever 127 of the nearby switch 124, a switch signal corresponding to one of positions 117, 118 and 119 is transmitted to the controller 123. When the controller 123 transmits a switching signal to the electromagnetic solenoids 111 based on the received switch signal, the electromagnetic solenoids 111 are excited and the spool 112 is set to corresponding one of positions X1, X2 and X3.

It may alternatively be constructed that the controller 123 is omitted and an operation signal is transmitted directly to the electromagnetic solenoids 111 by operating the nearby switch 124. A safety device, a hydraulic pressure detection means, an oil temperature detection means, means for detecting the position of the mode selector lever 45 and the like are connected to the controller 123 so that any switching signal is not transmitted to the electromagnetic solenoids 111 at the time of occurrence of abnormality or at the time of excavation work with the backhoe.

For example, when the switch lever 127 is slewed to the position 117, the spool 112 is set to the position X1. Then, pressure oil from the discharge port 134 of the hydraulic pump P3 is supplied through the pipe 135, the power steering control valve section 140, the pipe 103, the filter 104, the pipe 269, the solenoid valve 113 and the oil path 114 to the pressure oil chamber 120*d*. Simultaneously, pressure oil in the pressure oil chamber 120*e* is discharged through the oil path 115, the solenoid valve 113 and the pipe 171 to the pressure oil tank 33. Accordingly, as shown in FIG. 5, the operating piston 176 is moved upward and the operating piston 179 is moved downward, whereby the rocking body 182 is rotated along direction 146. Subsequently, the spool 145 is pulled upward via the backing plate 182*b* and the connection part 148 so that the PTO selector valve 240 is set to the position N, whereby pressure oil is supplied through the PTO port 260 to the external hydraulic apparatus and pressure oil is discharged through the PTO port 261.

When the switch lever 127 is slewed to the position 118, the spool 112 is set to the position X2, and pressure oil is not supplied to the pressure oil chambers 120*d* and 120*e*, whereby the operating pistons 176 and 179 do not push the rocking body 182 and the neutral state is realized at which the backing plates 182*b* and 182*c* are kept horizontal as shown in FIG. 4. Subsequently, the spool 145 is set to the position N so as to realize the neutral state, whereby pressure oil is not supplied to and discharged from the PTO ports 260 and 261.

When the switch lever 127 is slewed to the position 119, the spool 112 is set to the position X3. Then, pressure oil in the pressure oil chamber 120*d* is discharged through the oil path 114, the solenoid valve 113 and the pipe 171 to the pressure oil tank 33, and pressure oil from the discharge port 134 of the hydraulic pump P3 is supplied through the pipe 135, the power steering control valve section 140, the pipe 103, the filter 104, the pipe 269, the solenoid valve 113 and the oil path 115 to the pressure oil chamber 120*e*. Accordingly, the operating piston 176 is moved downward and the operating piston 179 is moved upward, whereby the rocking body 182 is rotated along direction 147 opposite to the direction 146. Subsequently, the spool 145 is pushed downward via the pressing plate 182*d* and the connection part 148 so that the PTO selector valve 240 is set to the position M, whereby pressure oil is supplied through the PTO port 261 to the external hydraulic apparatus and pressure oil is discharged through the PTO port 260. Accordingly, pressure oil can be supplied through the PTO ports 260 and 261 to the hydraulic actuator of the external hydraulic apparatus such as a breaker or a grapple.

Namely, in the selector valve operating mechanism 110 of the working vehicle 1 operating the PTO selector valve 240 which is a mechanical selector valve for controlling a hydraulic actuator driving a working machine attached as an attachment, the selector valve operating mechanism 110 includes the operating pistons 176 and 179 which are hydraulic pistons connected through the operation link 161 to the spool 145 of the PTO selector valve 240, the solenoid valve 113 hydraulically controlling reciprocal action of the operating pistons 176 and 179, and the controller 123 which is a control device transmitting an action signal to the solenoid valve 113. By the action control of the solenoid valve 113, the spool 145 is moved via the operating pistons 176 and 179 and the operation link 161 so as to operate the PTO selector valve 240. Accordingly, the PTO selector valve 240 can be operated with the solenoid valve 113 which is a small and cheap electromagnetic selector valve or the like. In comparison with the case of employing only a large and expensive electromagnetic selector valve, the oil path switching control construction can be simplified and the cost of parts thereof can be reduced. Furthermore, the nearby switch 124 or the like is interlocked with the action of the solenoid valve 113 so that the mechanical selector valve can be switched easily and quickly with small operation power similarly to the conventional electromagnetic selector valve, whereby switching operability can be improved widely. Moreover, the operating pistons 176 and 179 which are hydraulic pistons, the solenoid valve 113 and the like can be subsequently attached easily to the PTO selector valve 240 which is a current mechanical selector valve. Accordingly, the requirement of improvement of switching operability from a user can be measured quickly without changing the fundamental construction of the selector valve, whereby the working vehicle 1 superior in general-purpose properties can be provided.

The operating pistons 176 and 179 which are hydraulic pistons are, constructed integrally with the solenoid valve 113. Accordingly, the operating pistons 176 and 179 and the solenoid valve 113 are made to be a single unit structure so as to be attachable and detachable easily in the selector valve operating mechanism 110, whereby the assemble ability and maintainability can be improved. Furthermore, members required for oil paths and attachment members concerning the operating pistons 176 and 179 and the solenoid valve 113 can be made common, whereby the cost of parts can be reduced further. Moreover, the arrangement space for the operating pistons 176 and 179 and the solenoid valve 113 can be reduced, whereby the whole selector valve operating mechanism 110 can be made compact.

The operation piston which is a hydraulic piston includes the two operating pistons 176 and 179 respectively for moving forward and rearward the spool 145, and the operating pistons 176 and 179 are single acting type respectively having the pressure oil chambers 120*d* and 120*e* at only ones of the front and rear sides in the move direction of the pistons. Accordingly, unlike a double acting piston in which pressure oil chambers are provided at both front and rear sides in the move direction of the pistons, it is necessary to control only the hydraulic pressure in the pressure oil chamber at one of the sides and any complex position control mechanism for keeping the neutral position is not required, whereby the hydraulic pressure control construction can be simplified so as to improve responsibility of the pistons and to reduce the cost of parts further. However, of course, it may alternatively be constructed that the operating actuators 174 and 177 is constructed by an operation actuator having one operation piston of double acting type and is connected to the solenoid valve 113, and the operation piston is connected to the connection part 148.

Next, explanation will be given on a selector valve operating mechanism 110A which is another mode of the selector valve operating mechanism 110 referring to FIG. 7.

In the selector valve operating mechanism 110A, the spool 145 of the PTO selector valve 240 is moved by not the electromagnetic solenoids 111 but rotational power of an electric motor 190 so as to reduce the parts of hydraulic piping and the like.

In the selector valve operating mechanism 110A, a main body 190*a* of the motor 190 is fixed to the vertical wall surface of the operation frame 105 constructing the frame body of the operation part 10 by a bolt or the like (not shown), and a motor shaft 190*b* is projectingly provided horizontally from the main body 190*a*. The motor 190 is connected through a wire (not shown) to the controller 123, and the controller 123 is connected through the wire 128 to the nearby switch 124 provided in the operation part 10. Furthermore, the motor shaft 190*b* is connected through an operation link 149 to the outer upper end of the spool 145 of the PTO selector valve 240.

The operation link 149 includes a rocking part 191 and the connection part 148, and the rocking part 191 includes a boss 191*a* engaged around the motor shaft 190*b* and a pressing plate 191*b* projectingly provided radially from the outer perimeter of the boss 191*a*. The upper end of the connection stay 148*b* constructing the connection part 148 is rotatably connected through the connection shaft 148*a* to the pressing plate 191*b*, and the lower end of the connection stay 148*b* is connected to the outer upper end of the spool 145 of the PTO selector valve 240.

Accordingly, when the switch lever 127 of the nearby switch 124 is slewed, the motor 190 is driven and the pressing plate 191*b* of the rocking part 191 is rotated around the motor shaft 190*b*. Then, similarly to the selector valve operating mechanism 110, the spool 145 of the PTO selector valve 240 is moved via the pressing plate 191*b* and the connection part 148.

Namely, in the selector valve operating mechanism 110A of the working vehicle 1 operating the PTO selector valve 240 which is a mechanical selector valve for controlling a hydraulic actuator driving a working machine attached as an attachment, the selector valve operating mechanism 110A includes the motor 190 connected through the operation link 149 to the spool 145 of the PTO selector valve 240 and controllable electrically, and the controller 123 which is a control device transmitting an action signal to the motor 190. The spool 145 is moved via the operation link 149 by rocking output of the motor 190 so as to operate the PTO selector valve 240. Accordingly, the PTO selector valve 240 can be switched with a small and cheap motor. Therefore, in comparison with the case of employing only a large and expensive electromagnetic selector valve, the oil path switching control construction can be simplified and the cost of parts thereof can be reduced. Furthermore, the nearby switch 124 or the like is interlocked with the action of the motor 190 so that the mechanical selector valve can be switched easily and quickly with small operation power similarly to the conventional electromagnetic selector valve, whereby switching operability can be improved widely. Moreover, the motor 190 and the like can be subsequently attached easily to the PTO selector valve 240 which is a current mechanical selector valve, whereby the working vehicle 1 superior in general-purpose properties can be provided. In comparison with the case that the small solenoid valve 113 is employed for operating the mechanical selector valve, the hydraulic piping and the like can be reduced further, whereby the assemble ability and maintainability can be improved.

INDUSTRIAL APPLICABILITY

In addition to the backhoe loader described in the embodiment, in whole working vehicle such as a tractor, planting machine, a truck or the like, the present invention can be employed in whole selector valve operation mechanism for operating mechanical selector valves for controlling hydraulic actuators of an external hydraulic apparatus.

The invention claimed is:

1. A selector valve operating mechanism for a working vehicle which operates a mechanical selector valve for controlling a hydraulic actuator, comprising:

a hydraulic piston means connected through an operation link to a spool of the mechanical selector valve;

an electromagnetic valve hydraulically controlling reciprocal action of the hydraulic piston means; and a control device transmitting an action signal to the electromagnetic valve, wherein by action control of the electromagnetic valve, the spool is moved via the hydraulic piston means and the operation link so as to operate the mechanical selector valve, wherein the hydraulic piston means comprises two hydraulic pistons respectively for moving the spool forward and rearward, and each of the hydraulic pistons is single acting type having a pressure oil chamber at only one of front and rear sides in the move direction of the piston, and wherein the operation link is interlockingly connected to the spool and is configured to move based on the movement of the hydraulic piston means.

2. The selector valve operating mechanism for the working vehicle according to claim 1, wherein the hydraulic piston is constructed integrally with the electromagnetic valve.

* * * * *